US005690043A

United States Patent [19]

Muscara

[11] Patent Number: 5,690,043

[45] Date of Patent: Nov. 25, 1997

[54] AUTOMATIC ROBE BUNDLING DEVICE

[76] Inventor: Gerald J. Muscara, 336 Golf View Rd., North Palm Beach, Fla. 33408

[21] Appl. No.: 733,593

[22] Filed: Oct. 18, 1996

[51] Int. Cl.[6] ..... B63B 21/00

[52] U.S. Cl. ..... 114/230; 114/354; 242/361.5

[58] Field of Search ..... 114/230, 104, 114/112, 293, 253, 254; 242/360, 361.5, 362.2; 441/3–5

[56] References Cited

U.S. PATENT DOCUMENTS

| | | | |
|---|---|---|---|
| 1,811,400 | 6/1931 | McClellan | 114/230 |
| 3,395,668 | 8/1968 | George | 114/230 |
| 4,022,450 | 5/1977 | Smith, Jr. | 114/230 |
| 4,697,537 | 10/1987 | Smith | 114/230 |
| 5,365,872 | 11/1994 | Obrinski | 114/230 |

*Primary Examiner*—Jesus D. Sotelo
*Attorney, Agent, or Firm*—Norman Friedland

[57] ABSTRACT

A mooring line is automatically rewound into a bundle of loops by a rewinding reel that includes a rewinding line that is attached at spaced intervals by clamped eyelets with the last eyelet tied to the end of the rewinding line. The mooring line when attached to the boat is allowed to extend the length of the mooring line and the rewinding pulley attached to a suitable support such as a dock or piling automatically rewinds to form sequential loops forming the bundle of the mooring line.

10 Claims, 3 Drawing Sheets

AUTOMATIC ROBE BUNDLING DEVICE

TECHNICAL FIELD

This invention relates to a means for automatically bundling the rope that is used in mooring lines for securing boats or other vessels to the dock or the like.

BACKGROUND OF THE INVENTION

One of the problems that is evidenced with mooring lines is that when securing boats or ships to its mooring or dock the rope used in tying the boat in the securing position is typically manually thrown from the boat to the dock or vice versa or to other structure in the mooring. When the boat is unsecured the rope is then manually wrapped or in some instances left as it is and dropped into the water or onto the mooring. On occasion, in the act of throwing the rope from one place to another, the individual doing the throwing is known to lose his or her footing or balance and falls and sometimes into the water between the boat and dock. Obviously, this can result in injury to that person.

This invention is intended to obviate these problem by bundling the rope and retaining it in a fixed position on deck or any other location so that it is available for use whenever the boat is to be docked and secured. This invention contemplates utilizing a retractable pulley and cord where the cord is tied to the rope at spaced intervals so that the rope when not in use will automatically return to the bundled position. The retractable pulley may be attached to the piling or dock or any other convenient location. A. bracket is provided to mount the retractable pulley to the structure used to secure the mooring line.

There are many available rewinding pulleys that are commercially sold and can be utilized with this invention. Also, the literature discloses many rewinding pulleys. Examples of rewinding pulleys are listed below. U.S. Pat. No. 3,193,212 granted to Lotta on Jul. 6, 1965 entitled "Holder For Hidden Clothesline"; U.S. Pat. No. 4,697,537 granted to Smith on Oct. 6, 1987 entitled "Retractable Line Storage Device": U.S. Pat. No. 4,969,610 granted to Taylor et al on Nov. 13, 1990 entitled "Rope rewinding Device For Ski Boat"; and U.S. Pat. No. 2,915,259 granted to Force on Dec. 1, 1959 entitled "Water Ski Rope Reel".

It is also worthy of mention that certain gas hoses used in certain gas filling stations include a rewinding reel that secures the hose of the gas pump used in filling the gas tank of automobiles and the like so that the nozzle does not fall on the ground in the event it is left unattended. While these rewinding devices are useful and have utility in my invention, they do not address the problem of bundling the mooring line when it is not in use.

SUMMARY OF THE INVENTION

An object of this invention is to provide an improved mooring line that is bundled so that it is available when needed.

A feature of this invention is the use of clamps that are secured to the mooring line at spaced intervals that is attached to the line of the rewinding reel so that when not in use for mooring a boat or the like, the line is rewound and the mooring line is bundled. A bracket serves to secure the rewinding reel to a suitable support such as a dock or a piling.

The foregoing and other features of the present invention will become more apparent from the following description and accompanying drawings.

DETAILED DESCRIPTION OF THE PREFERRED EMBODIMENT

While this invention shows in the preferred embodiment the mooring line attached to a small boat and the rewinding reel attached to the piling, the scope of this invention is not limited to the type of vehicle or vessel being secured or the location of the rewinding reel. The piling or dock or any other support for the purposes of this invention is considered to be a static structural support member which may be disposed at any location.

Figure 1:
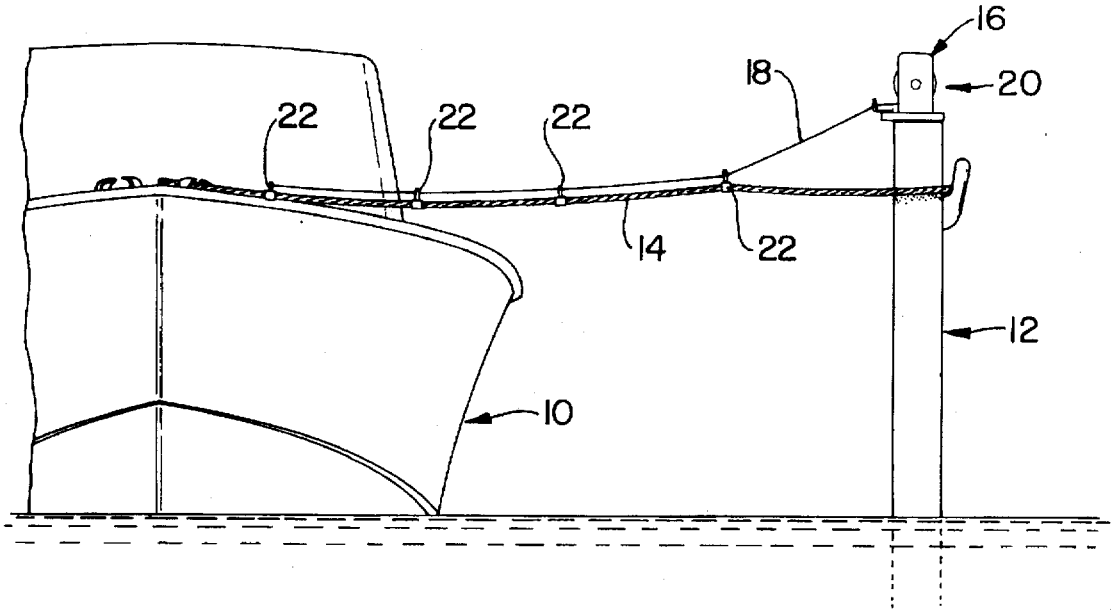
FIG. 1 is a schematic view of this invention illustrating the mooring line attached to a small boat.
Figure 5:
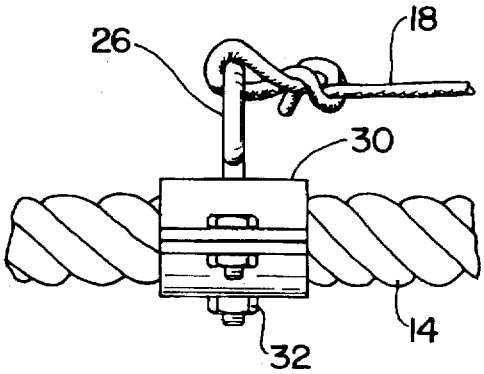
FIG. 5 is a partial view illustrating the end clamp of a plurality of clamps attached to the rope of the mooring line.
Figure 2:
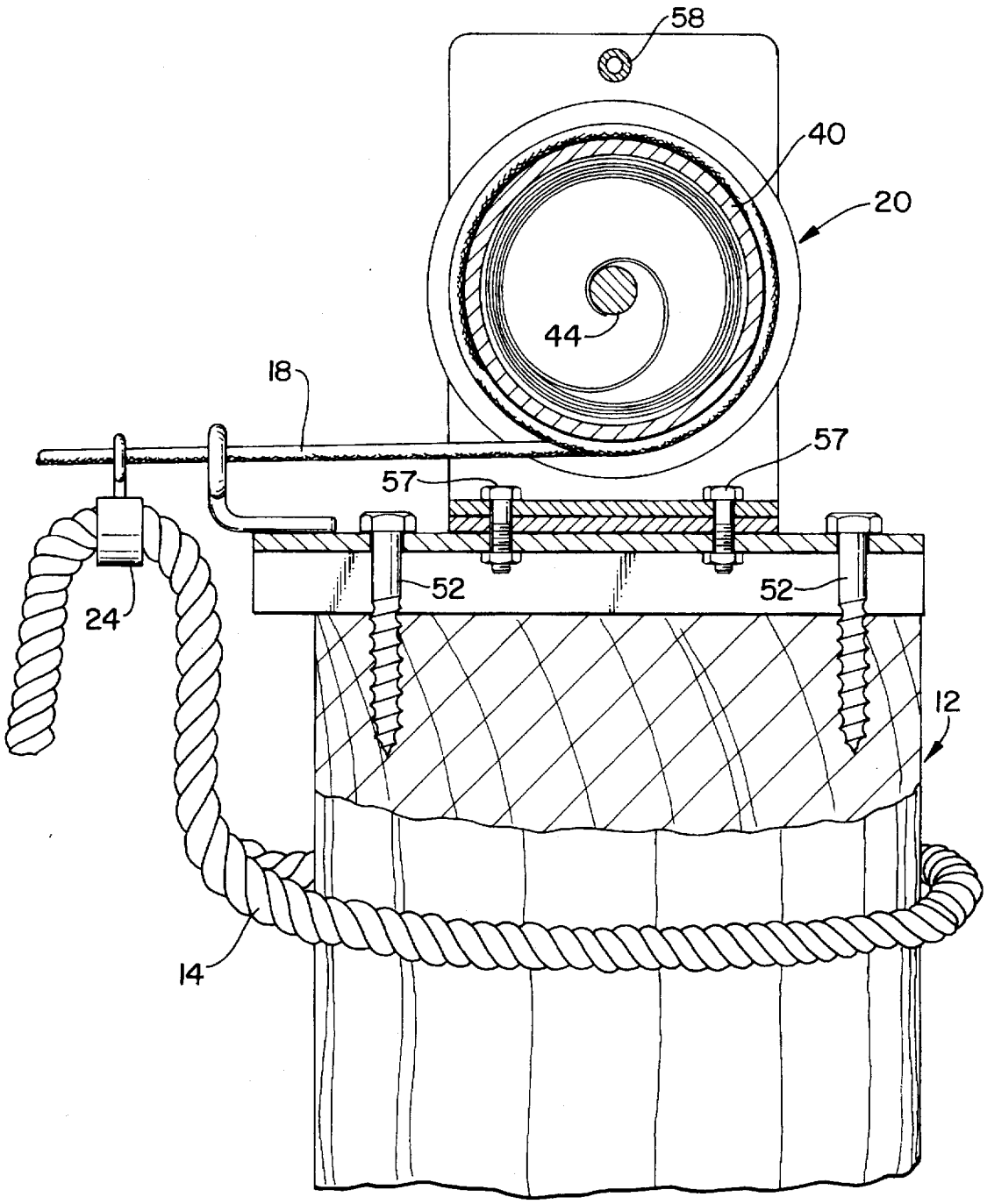
FIG. 2 is a sectional view partly in elevation illustrating the invention and the rewinding reel attached to the top of a piling.
Figure 3:
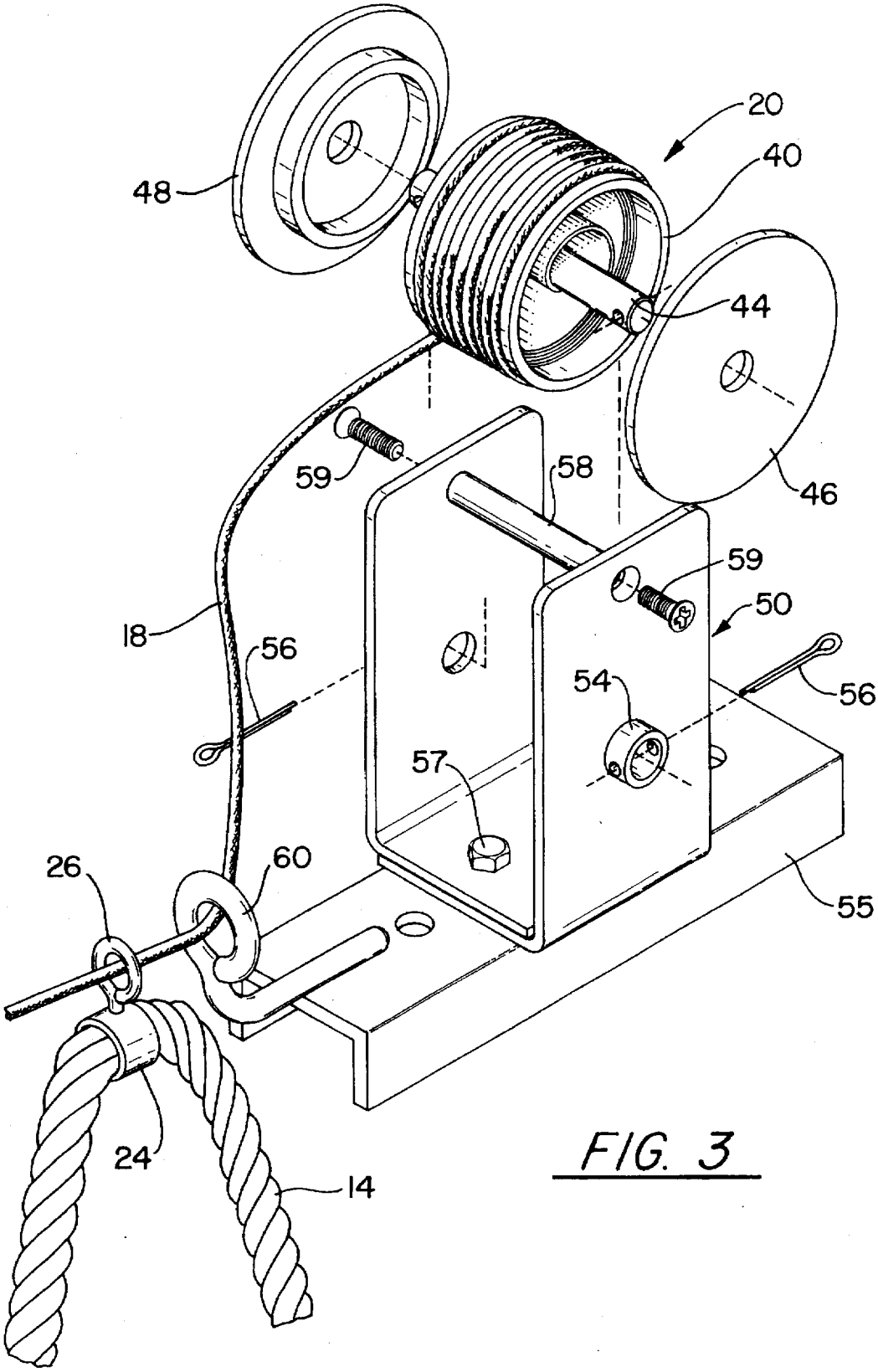
FIG. 3 is an exploded, partial view in perspective illustrating the details of this invention.

To appreciate this invention reference is now being made to all of the Figs. where FIG. 1 shows the details of this invention when used to secure a small boat 10 to the piling 12 by the mooring line 14, which may be commercially available rope or cable and the rewinding reel 16 attached to the piling 12. In accordance with this invention, the line or cord 18 attached to the rewinding drum 20 of pulley 16 includes a plurality of spaced clamps 22 all of which are secured to the mooring line or rope 14. The clamps may take the form a ring 24 as shown in FIGS. 1 and 2 that is swaged to frictionally fit on the mooring line with an eyelet 26 for receiving the rewinding line 18. Or the clamp may take the form of a split ring 30 as shown in FIG. 5 (as being illustrative of any type of clamp that may be utilized) the clamp 30 is a split ring that fits over the mooring line at the desired location and is tighten by the bolt 32 that threadably engages one of the halves of the split ring 30. As similar eyelet 26 is carried by the clamp. FIG. 5 illustrates the end clamp where the end of the rewinding line 18 is suitably tied to the end eyelet by a suitable knot.

The retractable or rewinding reel 20 may be any commercially available reel and in this instance it includes the drum 40 and the rewinding spring 42 having one end attached to the axle 44 and the other end affixed to the drum 14. The reel 20 may also include the end plates 46 and 48 forming a complete assembly. The reel is mounted in the U-shaped bracket 50 formed from L-shaped halves which may be attached to the U-shaped bracket 55 by the nut and bolt assemblies 57 which, in turn, is attached to piling 12 by suitable wood or concrete screws 52. The axle 44 attaches to the collar 54 affixed to one of the L-shaped halves and held into place by the cotter pin 56. A cylindrical spreader 58 abuts the L-shaped halves and is secured into place at the top of the U-shaped bracket by the machine bolts 59 threadably attached to the end of the spreader 58 to assure that the pulley doesn't bind. A guide eyelet 60 is suitably affixed to the U-shaped bracket 55 say by welding, and serves to guide the rewinding line 18.

Figure 4:
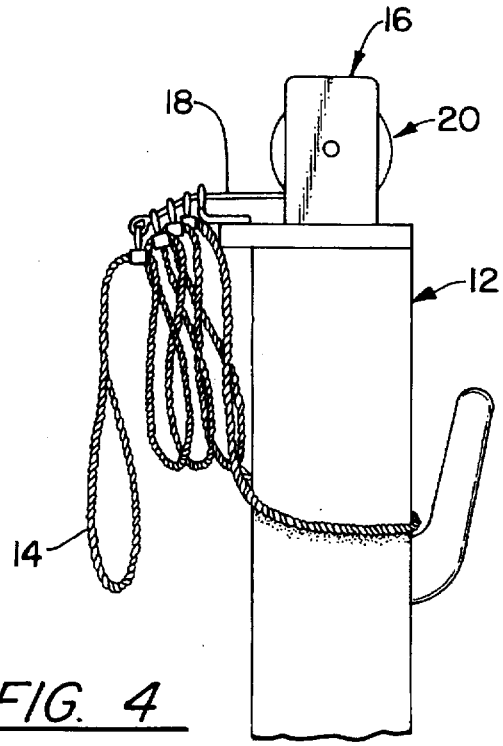
FIG. 4 is a view in elevation illustrating the mooring line rewound in the bundled position.

In operation the mooring line is bundled in the loops as shown in FIG. 4 and is ready for attachment. The operator holds on to the end of the mooring line say at the loop formed at the end thereof and unwinds the bundle. The loop is then attached to a suitable cleat affixed to the boat 10. The boat 10 is then free to move as far as the length of the mooring line 14. As is apparent from the foregoing when the boat is freed from the mooring line the mooring line by virtue of the present invention will be rebundled and held in position for the next mooring operation.

Although this invention has been shown and described with respect to detailed embodiments thereof, it will be appreciated and understood by those skilled in the art that various changes in form and detail thereof may be made without departing from the spirit and scope of the claimed invention.

I claim:

1. An automatic bundling device for a mooring line comprising a rewinding pulley having a rewinding cord, a plurality of clamping means affixed to said mooring line at spaced intervals, one end of said cord being tied to the last spaced clamping means and eyelets attached to each of said other of said plurality of clamping means for being disposed in sliding relationship with said cord passing through each of said other of said plurality of clamping means.

2. An automatic bundling device as claimed in claim 1 wherein said clamping means includes a circular ring encircling a portion of said mooring line.

3. An automatic bundling device as claimed in claim 1 wherein said clamping means includes a split ring member and means to tighten said split ring.

4. An automatic bundling device as claimed in claim 1 including pulley means and means for attaching said pulley means to a static structural support.

5. An automatic bundling device as claimed in claim 4 wherein said means for attaching said pulley means includes a bracket, and eyelet means attached to said bracket for guiding said cord.

6. Means for automatically bundling a mooring line having a fixed end attached to a dock or the like and adapted to secure a vessel thereto, a rewinding pulley having a rewinding cord attached thereto, a plurality of clamping means each affixed to said mooring line at spaced intervals, said clamping means having eyelets disposed in sliding relationship with said cord and being disposed so that said cord sequentially passes through each of said eyelets of said plurality of clamping means, an additional clamping means disposed at the end of said cord and affixed to said mooring line and being disposed at the leading end of said clamping means in relationship the free end of said mooring line whereby said mooring line is retracted in a bundle formed into a series of loops formed by said cord and said clamping means.

7. Means for automatically bundling a mooring line as claimed in claim 6 wherein said clamping means includes a circular ring encircling a portion of said mooring line.

8. Means for automatically bundling a mooring line as claimed in claim 6 wherein said clamping means includes a split ring member and means to tighten said split ring.

9. Means for automatically bundling a mooring line as claimed in claim 6 including pulley means and means for attaching said pulley means to a static structural support.

10. Means for automatically bundling a mooring line as claimed in claim 6 wherein said means for attaching said pulley means includes a bracket, and eyelet means attached to said bracket for guiding said cord.

* * * * *